US006354760B1

(12) United States Patent
Boxall et al.

(10) Patent No.: US 6,354,760 B1
(45) **Date of Patent: *Mar. 12, 2002**

(54) SYSTEM FOR TRANSFERRING LOADS BETWEEN CAST-IN-PLACE SLABS

(76) Inventors: Russell Boxall, 3011 Windsor Chase Dr., Matthews, NC (US) 28105; Nigel K. Parkes, 3473 Palace Ct., Tucker, GA (US) 30084

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/195,320

(22) Filed: Nov. 18, 1998

Related U.S. Application Data

(60) Provisional application No. 60/066,963, filed on Nov. 26, 1997.

(51) Int. Cl.[7] ..... E01C 5/14; E04B 2/00

(52) U.S. Cl. ..... 404/56; 404/47; 52/585.1

(58) Field of Search ..... 404/47, 48, 50, 404/51, 55, 56, 57, 58, 53, 54, 40, 41; 14/73.1; 104/138.1; 472/85; 52/585.1, 586.1; 446/108, 111; 403/292, 294, 405.1, 406.1, 408.1

(56) References Cited

U.S. PATENT DOCUMENTS 714,971 A 12/1902 Thacher
811,560 A 2/1906 Hinchman
828,550 A 8/1906 Inman et al.

(List continued on next page.)

FOREIGN PATENT DOCUMENTS

EP 0059171 A1 9/1982

OTHER PUBLICATIONS

Ralph E. Spears, "*Concrete Floors on Ground*", Portland Cement Association, Second Edition (1983).
American Concrete Pavement Association, "*Design and Construction of Joints for Concrete Highways*" (1991).
American Concrete Pavement Association, "*Design and Construction of Joints for Concrete Streets*", (1992).
American Concrete Institute, ACI Committee 302, "*Guide for Concrete Floor and Slab Construction*", ACI 302.1R–96 (1997).
Laser Form *pamphlet* entitled: "Who's going to use Laser Form first? You or your competition?".
Laser Form *brochure* entitled: "Who's going to use Laser Form first? You or your competition?".

*Primary Examiner*—Gary S. Hartmann
(74) *Attorney, Agent, or Firm*—Banner & Witcoff, Ltd.

(57) ABSTRACT

A load plate for transferring loads between a first cast-in-place slab and a second cast-in-place slab separated by a joint. The load plate having a substantially tapered end having substantially planar upper and lower surfaces adapted to protrude into and engage the first slab, and the load plate being adapted to transfer between the first and second slabs a load directed substantially perpendicular to the intended upper surface of the first slab. A blockout sheath embedded within the first slab could also be included. The block out sheath could have a substantially planar top surface and a substantially planar bottom surface substantially parallel to the upper surface of the first slab. The top and bottom surfaces of the blockout sheath could each have a width, measured parallel to an intersection between the joint surface and the upper surface of the first slab, that substantially decreases away from the joint surface. The width of the blockout sheath could be substantially greater than the width of the substantially tapered end at each corresponding depth along the substantially tapered end and the blockout sheath, such that the substantially tapered end could move within the sheath in a direction parallel to the intersection between the upper surface of the first slab and the joint surface.

26 Claims, 11 Drawing Sheets

U.S. PATENT DOCUMENTS

| | | | | | |
|---|---|---|---|---|---|
| 881,762 | A | | 3/1908 | Adreon, Jr. | |
| 1,092,734 | A | | 4/1914 | McLoughlin | |
| 2,103,337 | A | | 12/1937 | Oury | 72/106 |
| 2,308,677 | A | * | 1/1943 | Dailey | |
| 3,430,406 | A | | 3/1969 | Weber | 52/660 |
| 3,434,263 | A | | 3/1969 | Beckman et al. | 52/715 |
| 3,559,541 | A | * | 2/1971 | Watstein | |
| 3,561,185 | A | | 2/1971 | Finsterwalder et al. | 52/737 |
| 4,531,564 | A | * | 7/1985 | Hanna | |
| 4,733,513 | A | | 3/1988 | Schrader et al. | 52/396 |
| 5,005,331 | A | | 4/1991 | Shaw et al. | 52/396 |
| 5,216,862 | A | | 6/1993 | Shaw et al. | 52/396 |
| 5,419,965 | A | | 5/1995 | Hampson | 428/397 |
| 5,458,433 | A | * | 10/1995 | Stastny | |
| 5,487,249 | A | | 1/1996 | Shaw et al. | 52/396.02 |
| 5,640,821 | A | * | 6/1997 | Koch | |
| 5,674,028 | A | * | 10/1997 | Norin | |
| 5,730,544 | A | * | 3/1998 | Dils et al. | |
| 6,145,262 | A | | 11/2000 | Schrader et al. | |
| 6,195,956 | B1 | | 3/2001 | Reyneveld | |

* cited by examiner

FIG. 11
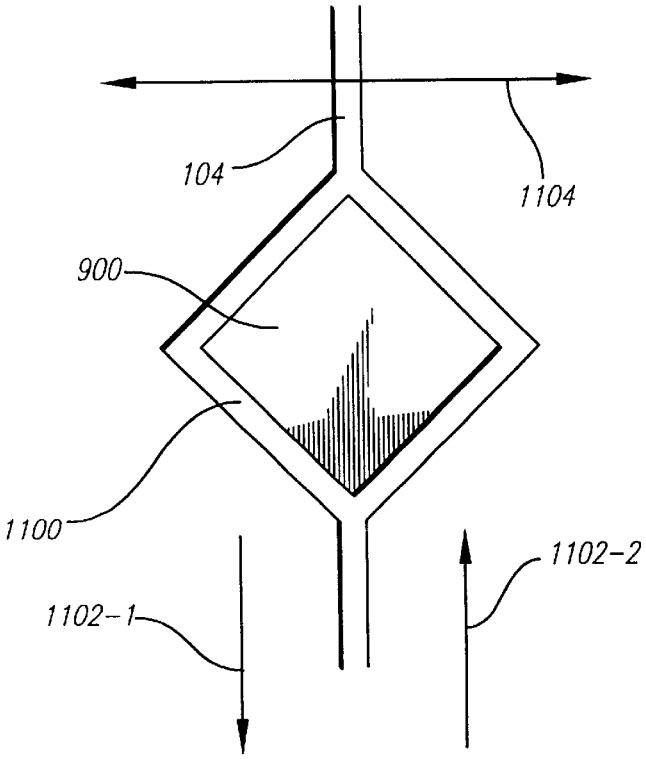
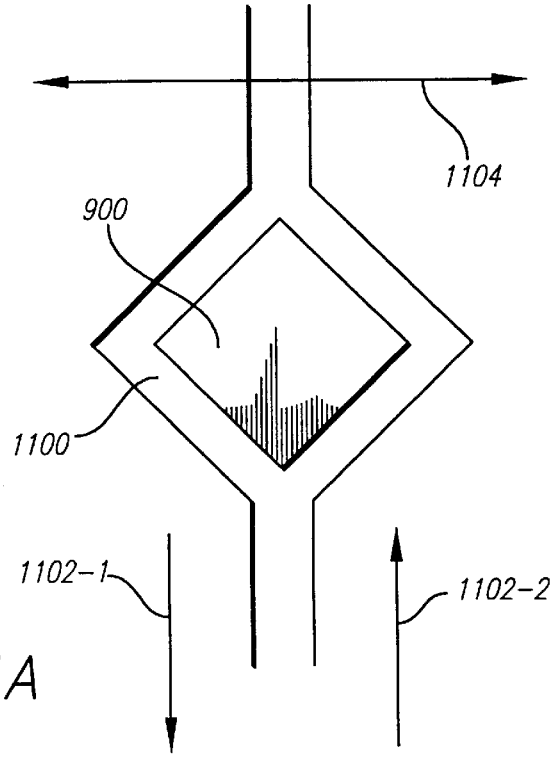
FIG. 11A

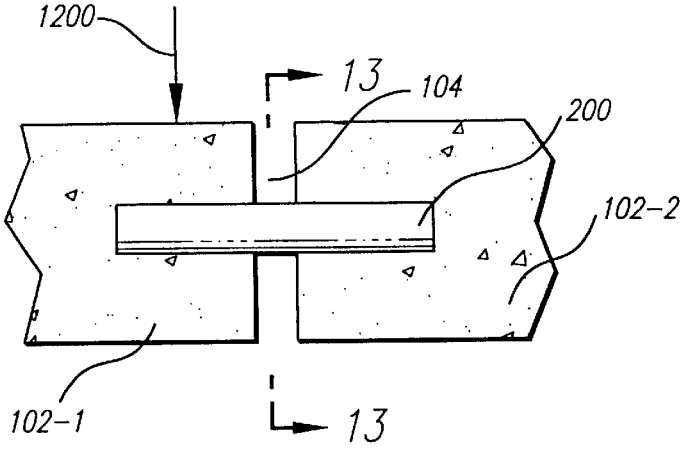
FIG. 12
PRIOR ART
FIG. 13
PRIOR ART
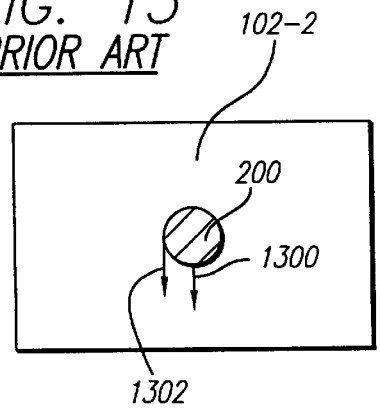
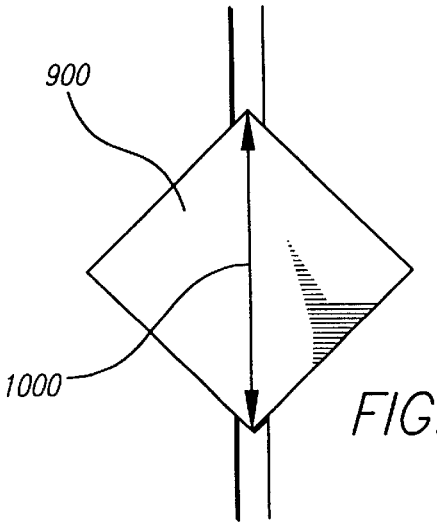
FIG. 14
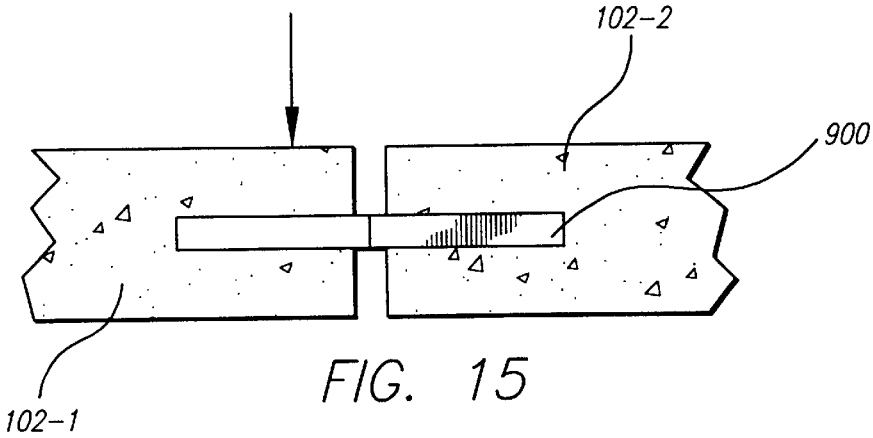
FIG. 15

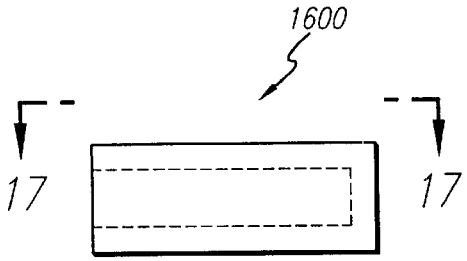
FIG. 16
FIG. 17
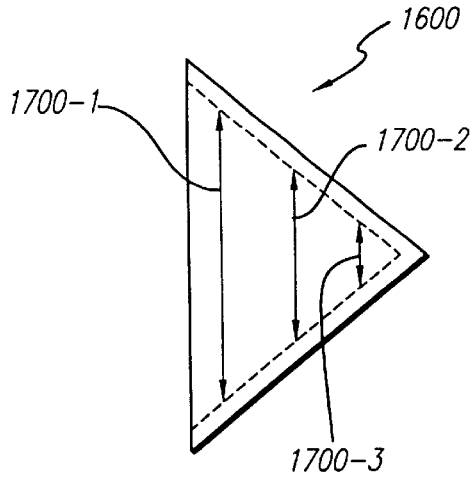
FIG. 18
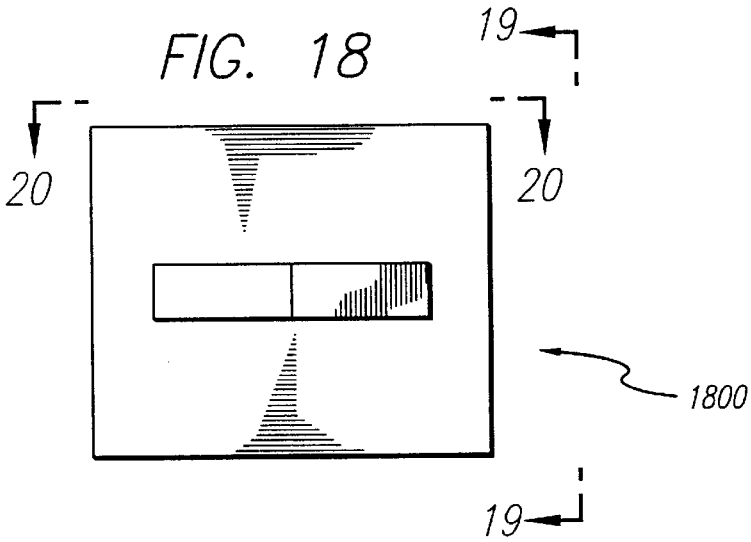
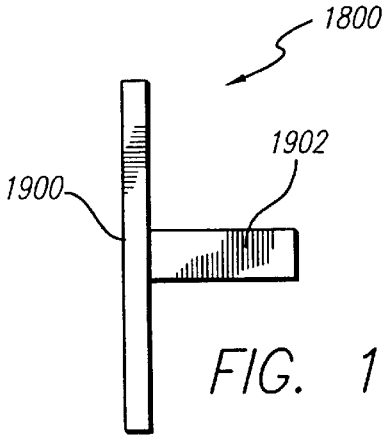
FIG. 19
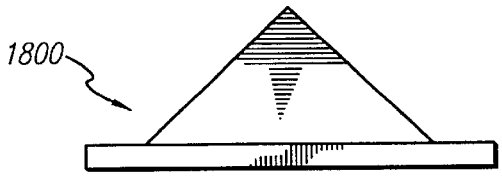
FIG. 20

FIG. 22
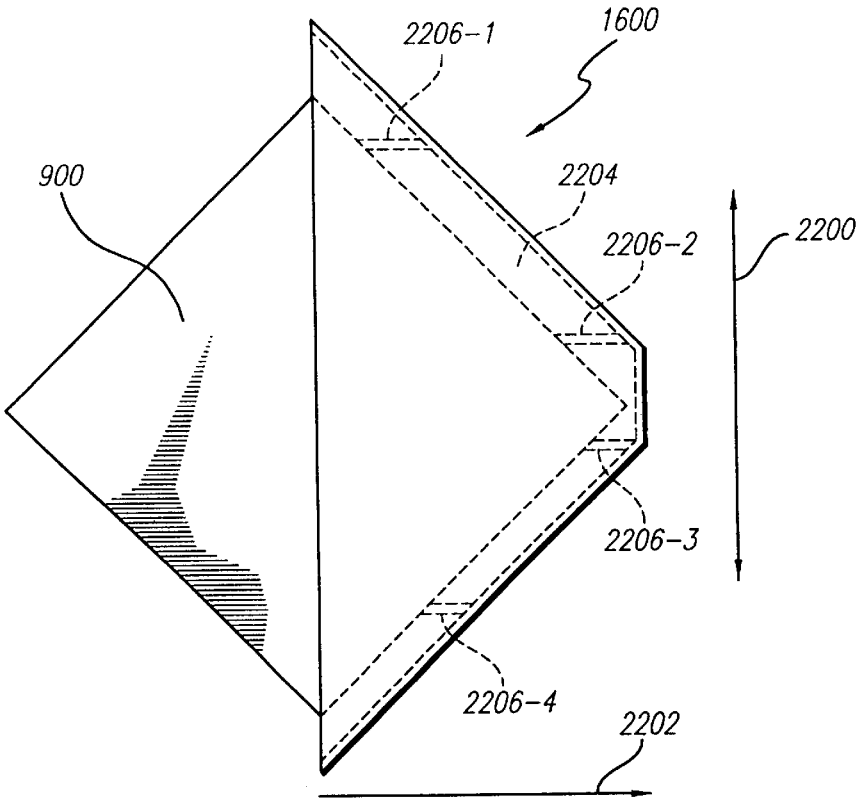
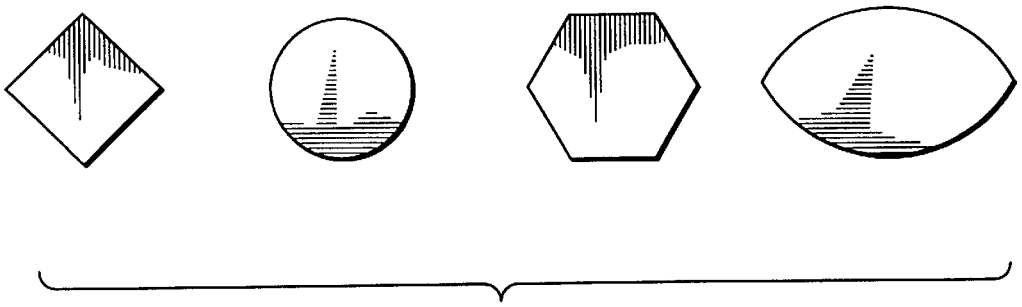
FIG. 23

SYSTEM FOR TRANSFERRING LOADS BETWEEN CAST-IN-PLACE SLABS

CROSS-REFERENCE TO RELATED APPLICATIONS

This application claims the benefit of the Nov. 26, 1997 filing date of copending provisional application Ser. No. 60/066,963.

BACKGROUND OF THE INVENTION

1. Field of the Invention

This invention relates generally to transferring loads between adjacent cast-in-place slabs and more particularly to a system for transferring, across a joint between a first slab and a second slab, a load applied to either slab.

2. Related Art

Referring to FIG. 1, a concrete floor 100 is typically made up of a series of individual blocks or slabs 102-1 through 102-6 (collectively 102), as shown in FIG. 1. The same is true for sidewalks, driveways, roads, and the like. Blocks 102 provide several advantages including relief of internal stress due to drying shrinkage and thermal movement. Adjacent blocks 102 meet each other at joints, such as joints 104-1 through 104-7 (collectively 104). Joints 104 are typically spaced so that each block 102 has enough strength to overcome internal stresses that would otherwise cause random stress relief cracks. In practice, blocks 102 should be allowed to move individually but should also be able to transfer loads from one block to another block. Transferring loads between blocks 102 is usually accomplished using smooth steel rods, also referred to as dowels, embedded in the two blocks 102 defining the joint 104. For instance, FIG. 2 is a side view of dowel 200 between slabs 102-4 and 102-5. FIG. 3 is a cross-sectional plan view along a section a portion of which is depicted by sectional arrow 3—3 in FIG. 2. FIG. 3 shows several dowels 200 spanning joints 104 between slabs 102. Typically, a dowel or bar 200 is approximately 14 to 24 inches long, has either a circular or square cross-sectional shape, and a thickness of approximately 0.5–2 inches. Such circular or square dowels are capable of transferring loads between adjacent slabs 102, but have several shortcomings.

U.S. Pat. Nos, 5,005,331, 5,216,862, and 5,487,249 issued to Shaw et al., which are incorporated herein by reference, disclose tubular dowel receiving sheaths for use with dowel bars having a circular cross-section.

If circular or square dowels, are misaligned (i.e., not positioned perpendicular to joint 104), they can undesirably lock the joint together causing unwanted stresses that could lead to slab failure in the form of cracking. Misaligned dowels 200 are illustrated in FIG. 4. Such misaligned dowels can restrict movement in the directions indicated arrows 400-1 and 400-2.

Another shortcoming of square and round dowels is that they typically allow slabs 102 to move only along the longitudinal axis of the dowel. As shown in FIG. 5, movement in the direction parallel to the dowels 200, as depicted by double-headed arrow 500 is allowed, while movement in other directions, such as the directions indicated arrows 502-1 and 502-2 and the directions which could be referred to as "into the page" and "out from the page" is restrained. Such restraint of movement in directions other than parallel to the longitudinal axes of dowels 200 could result in slab failure in the form of cracking.

U.S. Pat. No. 4,733,513 ('513 patent) issued to Shrader et al., which is incorporated herein by reference, discloses a dowel bar having a rectangular cross-section and resilient facings attached to the sides of the bar. As disclosed in column 5, at lines 47–49 of the '513 patent, such bars, when used for typical concrete paving slabs, would have a cross-section on the order of ½ to 2-inch square and a length on the order of 2 to 4 feet.

Referring to FIGS. 6 and 7, yet another shortcoming of prior art dowel bars results from the fact that, under a load, only the first 3–4 inches of each dowel bar is typically used for transferring the load. This creates very high loadings per square inch at the edge of slab 102-2, which can result in failure 600 of the concrete below dowel 200, as shown from the side in FIG. 6, and as shown in FIG. 7 along sectional view arrows 7—7 in FIG. 6. Such a failure could also occur above dowel 200.

Accordingly, there is a need in the prior art for an improved system that will provide both: (1) increased relative movement between slabs in a direction parallel to the longitudinal axis of the joint; and (2) reduced loadings per square inch close to the joint, while transferring loads between adjacent cast-in-place slabs.

SUMMARY OF THE INVENTION

A load plate for transferring loads between a first cast-in-place slab and a second cast-in-place slab separated by a joint. The load plate comprising a substantially tapered end having substantially planar upper and lower surfaces adapted to protrude into and engage the first slab, and the load plate being adapted to transfer between the first and second slabs a load directed substantially perpendicular to the intended upper surface of the first slab. The substantially tapered end could have a largest width, measured parallel to the longitudinal axis of the joint, substantially no less than twice the depth to which the substantially tapered end protrudes into one of the slabs. The height of the load plate, measured perpendicular to the upper surface of the first slab, could be substantially less than one-eighth of the largest width of the substantially tapered end.

A blockout sheath embedded within the first slab could also be included. The block out sheath could have a substantially planar top surface and a substantially planar bottom surface substantially parallel to the upper surface of the first slab. The top and bottom surfaces of the blockout sheath could each have a width, measured parallel to an intersection between the joint surface and the upper surface of the first slab, that substantially decreases away from the joint surface. The width of the blockout sheath could be substantially greater than the width of the substantially tapered end at each corresponding depth along the substantially tapered end and the blockout sheath, such that the substantially tapered end could move within the sheath in a direction parallel to the intersection between the upper surface of the first slab and the joint surface. The blockout sheath could include a plurality of deformable centering fins or other means for initially centering the substantially tapered end of the load plate within the width of the sheath. The largest width of the substantially tapered end of the load plate could be substantially no less than twice the depth of the substantially tapered end. The height of the load plate could be substantially less than one-eighth the largest width of the substantially tapered end of the load plate.

This invention also comprises a load plate kit having component parts capable of being assembled during creation of a joint between first and second cast-in-place slabs including: a mounting plate adapted to be attached to the edge form; a blockout sheath adapted to be attached to the mounting plate; and a load plate such that the load plate and blockout sheath are adapted to transfer a load between the first and second slabs.

This invention also comprises a method of installing a load plate for transferring loads between a first cast-in-place slab and a second cast-in-place slab, including the steps of: placing an edge form on the ground; attaching a substantially tapered blockout sheath to the edge form; removing the edge form from the first slab, with the blockout sheath remaining within the first slab; inserting a substantially tapered end of a load plate into the substantially tapered blockout sheath, a remaining portion of the load plate protruding into a space to be occupied by the second slab; pouring cast-in-place material into the space to be occupied by the second slab; and allowing the second slab to harden.

BRIEF DESCRIPTION OF THE DRAWINGS

FIG. 11 is a top view of a load plate between adjacent cast-in-place slabs.

FIG. 11A illustrates how the voids between load plates and slabs increases due to the opening of a joint and the tapered shape of the load plate.

FIG. 12 is a side view of a dowel bar and two adjacent cast-in-place slabs.

FIG. 13 is a sectional view along sectional view line 13—13 in FIG. 12.

FIG. 14 is a top view of a load plate.

FIG. 15 is a side view of a load plate and two adjacent cast-in-place slabs.

FIG. 16 is a side view of a blockout sheath.

FIG. 17 is a top view of the blockout sheath shown in FIG. 16 along sectional view line 17—17 in FIG. 16.

FIG. 18 is a front view of a mounting plate.

FIG. 19 is a side view of the mounting plate shown in FIG. 18 along sectional view line 19—19 in FIG. 18.

FIG. 20 is a top view of a mounting plate shown in FIG. 18 along sectional view line 20—20 in FIG. 18.

FIG. 22 is a top view of a blockout sheath and load plate showing the capability to allow extra relative movement between adjacent slabs along the longitudinal axis of the joint.

FIG. 23 is a top view of several alternative shapes for load plates.

DETAILED DESCRIPTION OF THE PREFERRED EMBODIMENTS

Figure 8:
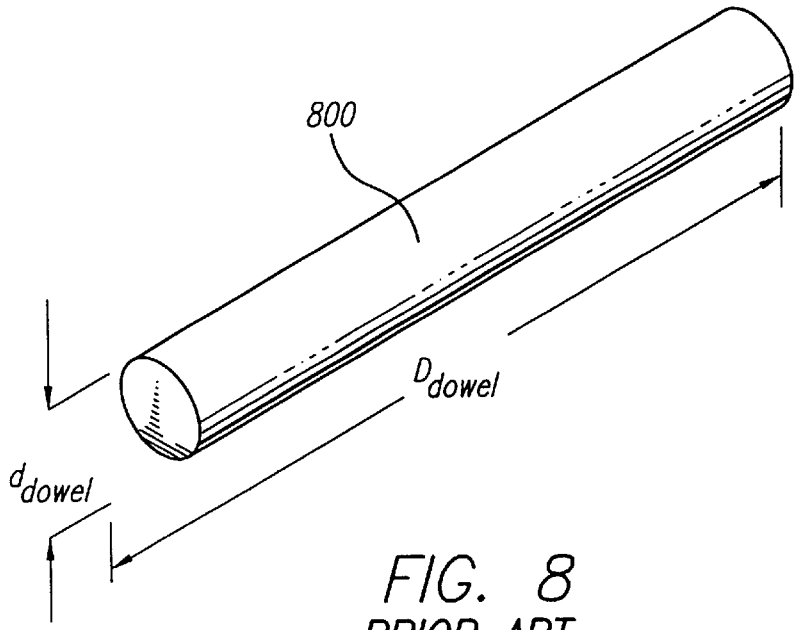
FIG. 8 PRIOR ART
FIG. 8 is a perspective view of a dowel bar having a circular cross-section.
Figure 9:
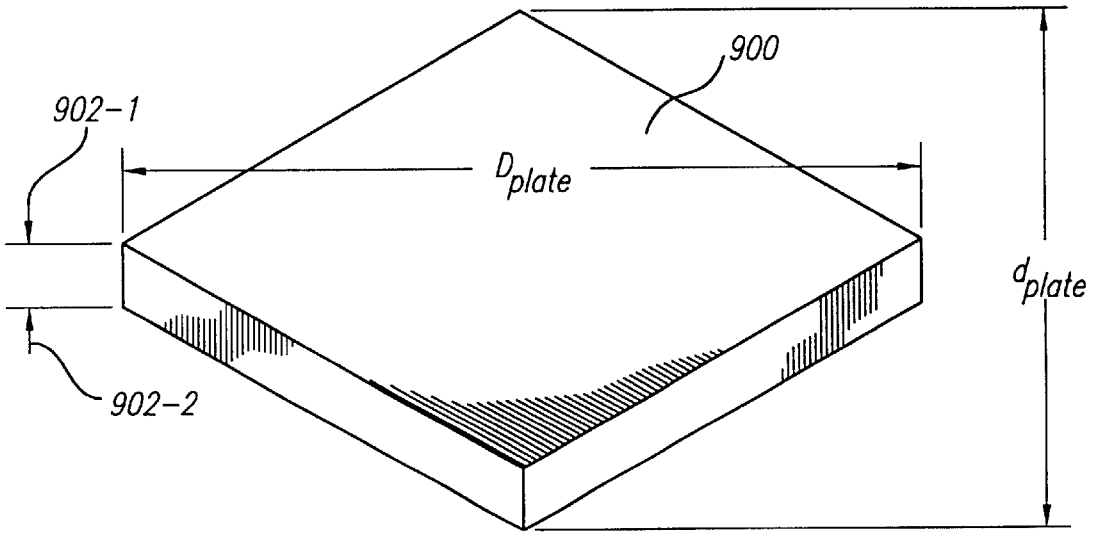
FIG. 9 is a perspective view of a load plate.

Instead of a dowel to transfer a load between adjacent cast-in-place slabs, a plate that is relatively wide compared to its thickness or height and has a length to width ratio close to 1:1 can be used. A standard circular dowel is shown in FIG. 8. Typically, the length, $D_{dowel}$, of a standard circular dowel 800 is approximately 20 times the cross-sectional diameter, $d_{dowel}$, shown in FIG. 8. A load plate 900 according to the principles of this invention, however, could have a ratio between its width $d_{plate}$ and its length $D_{plate}$ of approximately 1:1. As will be apparent to those skilled in the art, other suitable dimensions could also be used without departing from the scope of this invention. The thickness or height, as defined by arrows 902-1 and 902-2 could be significantly less than, for instance, less than one-eighth of, $D_{dowel}$ or $d_{dowel}$. As will be apparent to those skilled in the art, other suitable thicknesses could also be used without departing from the scope of this invention.

Figure 10:
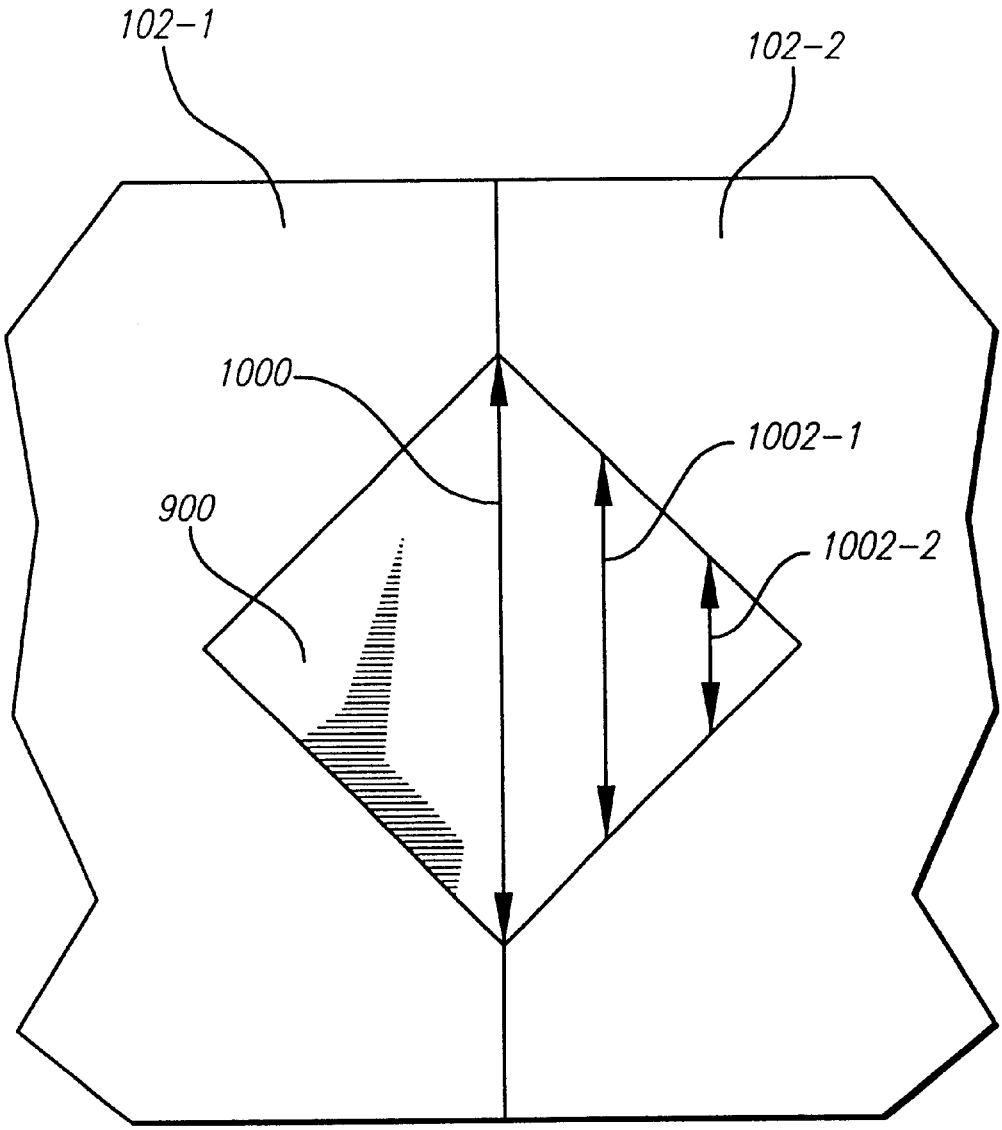
FIG. 10 is a top view depicting the decreasing width of a tapered end of a load plate.

Load plate 900 will typically have its greatest width closest to joint 104. Referring to FIG. 10, the greatest width of load plate 900 is depicted by double-headed arrow 1000. Typically, the width of load plate 900 will generally taper as it extends into a slab 102, as shown by the decreasing length of double-headed arrows 1002-1 and 1002-2.

Referring to FIG. 11, void 1100 could be created by shrinkage of slabs 102-1 and 102-2 as depicted by double-headed arrow 1104. Such shrinkage could allow slabs 102-1 and 102-2 to move relative to each other in either direction parallel to the longitudinal axis of joint 104, which directions are depicted by arrows 1102-1 and 1102-2 in FIG. 11. This is a significant advantage, relative to prior art dowels, provided by the tapered shape of load plate 900. As the slabs move away from each other along double-headed arrow 1104, which is typically caused by slab shrinkage, both the width and depth of void 1100 increase, as shown in FIG. 11A, allowing increased relative movement between the slabs parallel to the longitudinal axis of joint 104 in the directions indicated by arrows 1102-1 and 1102-2.

Figure 11B:
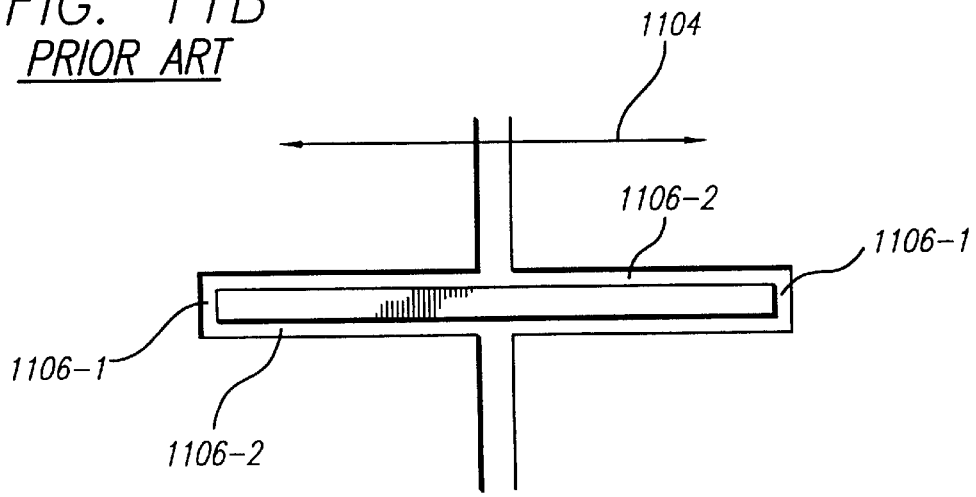
FIG. 11B PRIOR ART
FIG. 11B is a top view of a dowel between adjacent cast-in-place slabs.
Figure 11C:
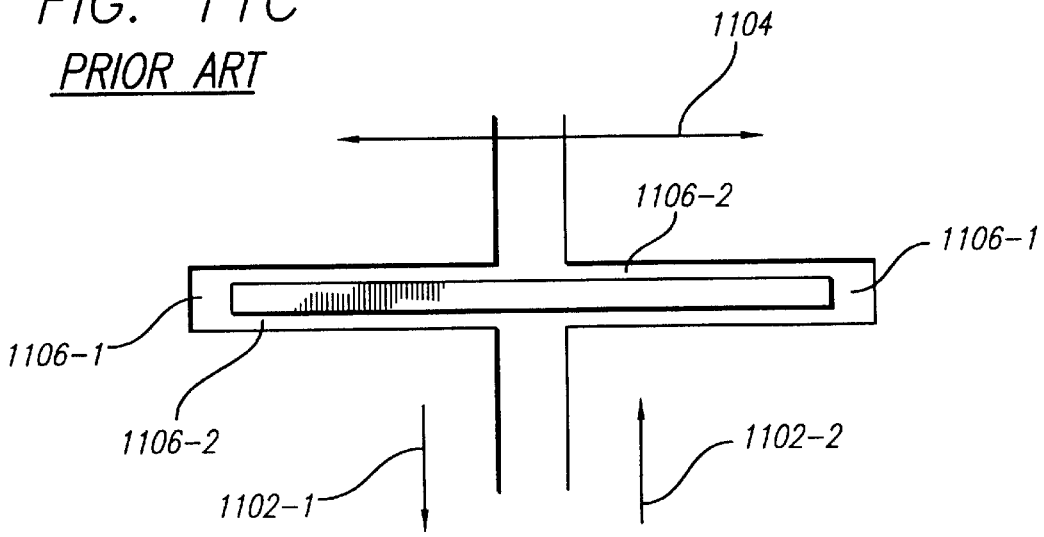
FIG. 11C PRIOR ART
FIG. 11C illustrates how the width of the voids between dowel bars and slabs do not increase due to the opening of a joint.

FIG. 11B show a prior art dowel being used for transferring loads between adjacent cast-in-place slabs. The void between each slab and a prior art dowel is depicted as having a depth 1106-1 and a width 1106-2. When such slabs move away from each other along double-headed arrow 1104, as shown in FIG. 11C, void depths 1106-1 increase, but void widths 1106-2 do not increase. Accordingly, unlike the increased void 1100 created by the tapered shape of load plate 900, no additional movement parallel to the longitudinal axis of joint 104, as depicted by arrows 1102-1 and 1102-2, is provided, as shown in FIG. 11C, as the slabs move apart from each other.

Figure 1:
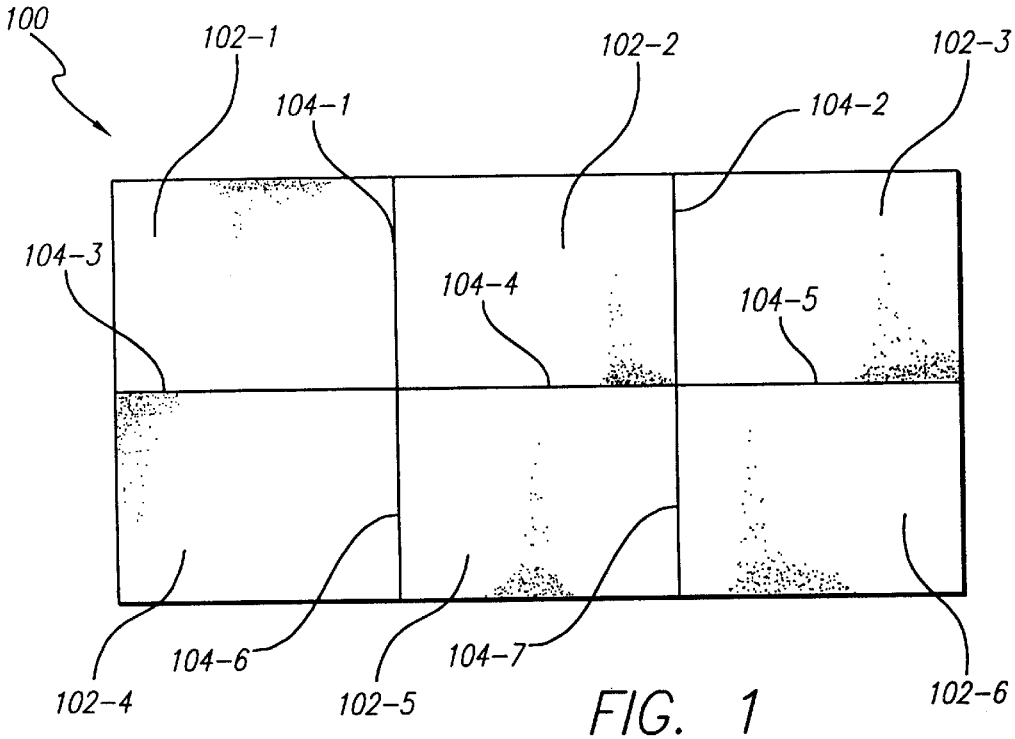
FIG. 1 PRIOR ART
FIG. 1 is a top view of a concrete floor.
Figure 3:
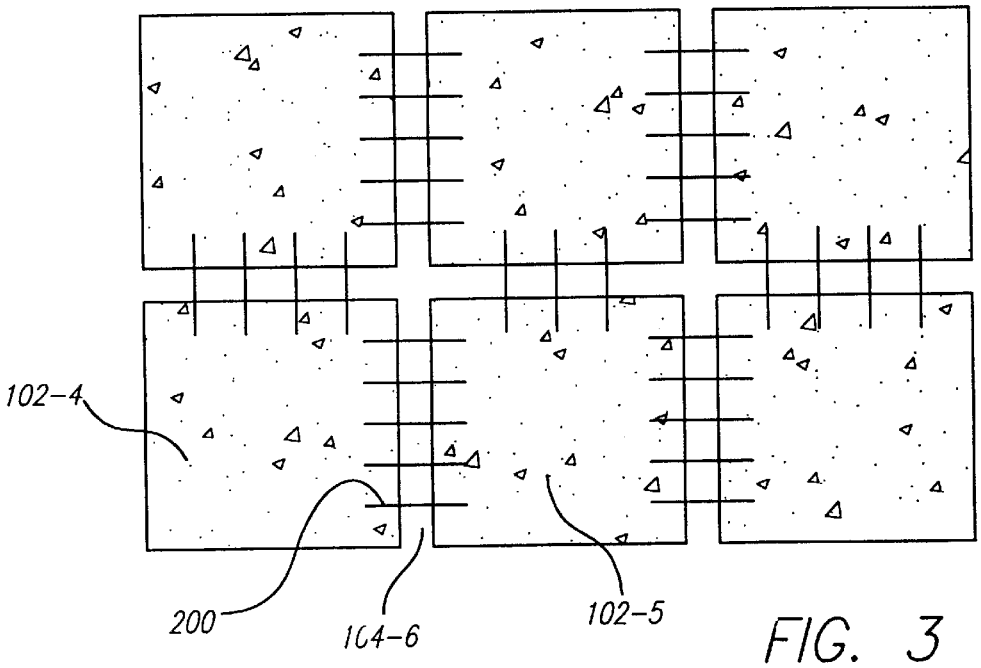
FIG. 3 PRIOR ART
FIG. 3 is a cross-sectional plan view along a section a portion of which is depicted by sectional arrow 3—3 in FIG. 2.
Figure 2:
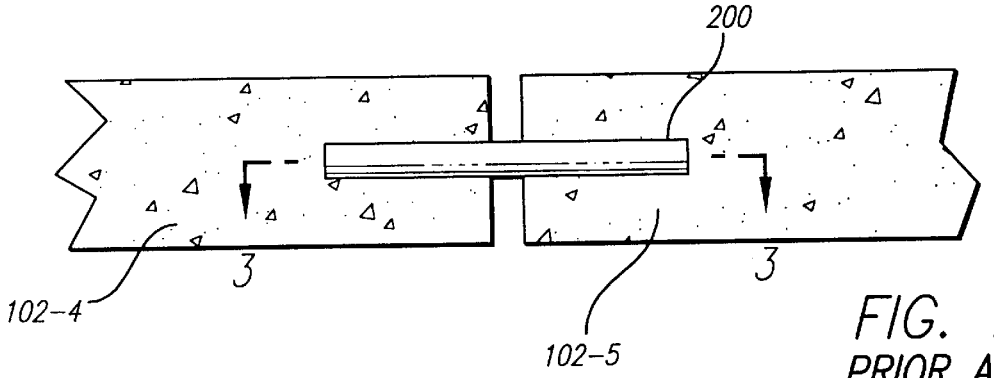
FIG. 2 PRIOR ART
FIG. 2 is a side view of two concrete floor slabs and a dowel spanning the joint between them and protruding into both slabs.
Figure 6:
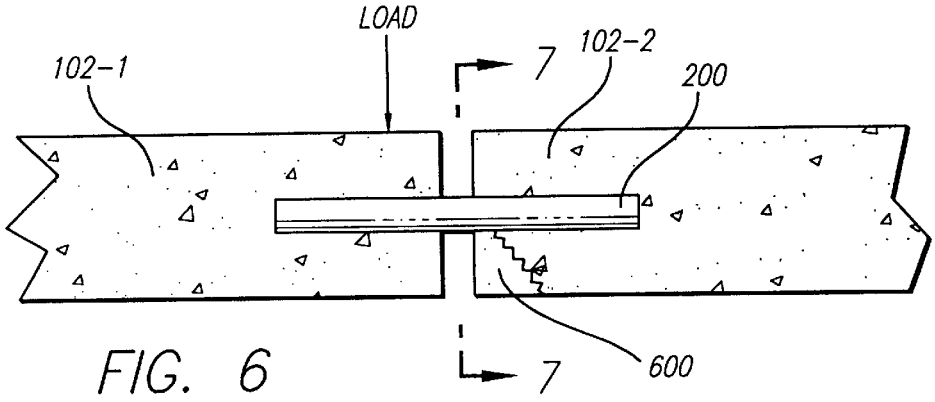
FIG. 6 PRIOR ART
FIG. 6 is a side view showing slab failure caused by a dowel.
Figure 7:
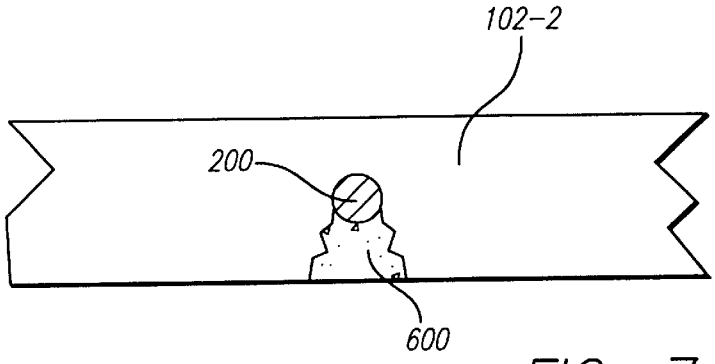
FIG. 7 PRIOR ART
FIG. 7 shows the slab failure shown in FIG. 6 from a sectional view along sectional view arrows 7—7 in FIG. 6.
Figure 4:
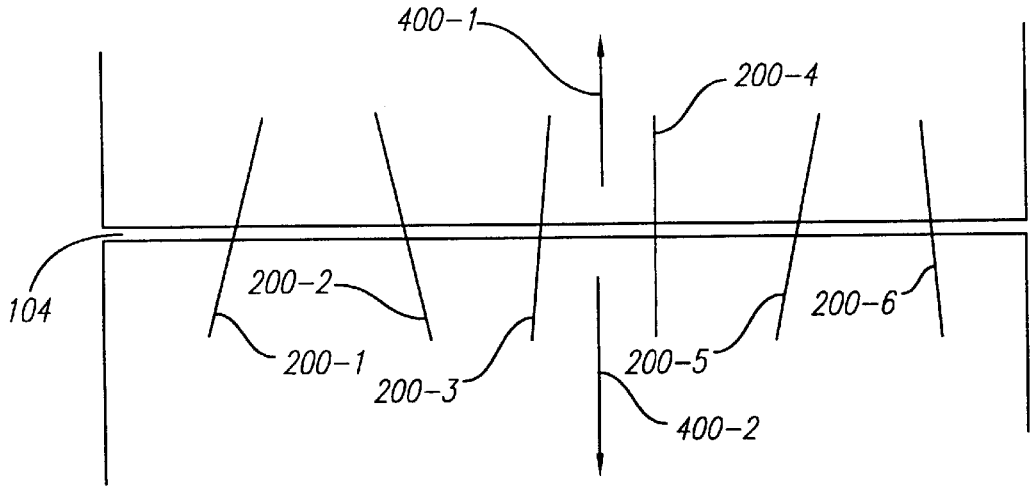
FIG. 4 PRIOR ART
FIG. 4 is a top view of how misaligned dowels can restrict relative movement by adjacent slabs toward or away from a joint.
Figure 5:
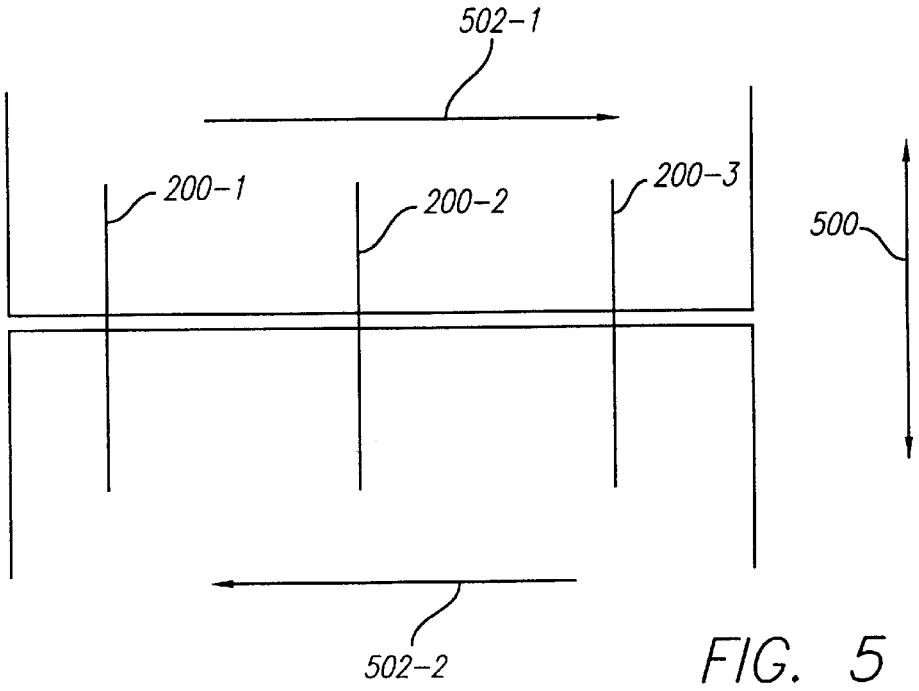
FIG. 5 PRIOR ART
FIG. 5 is a top view depicting how dowels restrict relative movement by adjacent slabs along the longitudinal axis of a joint.

In addition, the tapered shape of load plate 900 eleiminates locking of joints caused by misaligned dowel bars, which misalignment and locking are depicted in FIG. 4.

Load plate 900 will generally produce its smallest load per square inch at its widest point, which, advantageously, will generally be located where slabs 102 meet at joint 104. Load plate 900 thereby reduces failure of slabs close to joints, which, in turn, overcomes a significant shortcoming of prior art dowel bars. The tapered shape of load plate 900 places more plate material closer to joint 104 and less material further away from joint 104, thereby producing lower loads per unit area closer to joint 104 where loads are significantly greater. Unlike prior art dowels, the tapered shape of load plate 900 places less material further from joint 104 where loading is significantly reduced compared with loads closer to joint 104. As a result, load plate 900 optimizes the use of material relative to prior art dowels, which undesirably place more dowel material than necessary deep into slabs 102 and not enough material close to joints 104.

A simplified comparison of the loads per unit area produced by a load plate 900 and a prior art dowel are presented below. FIG. 12 shows a 1000 pound load, depicted by arrow 1200, being applied to slab 102-1. Dowel 200 extends into slabs 102-1 and 102-2 and passes through joint 104. Dowel 200 has a cross-sectional diameter of 0.75 inches, as shown in FIG. 13, which is a sectional view along sectional view line 13—13 in FIG. 12. The load bearing area of such a dowel can be approximated as follows:

load bearing area for dowel 200

$=\pi\times D/2\times$loaded length $=3.14159\times 0.75$ inches$/2\times 4$ inches $=4.7$ square inches load per area for dowel 200

=1000 lbs./4.7 square inches

=212 p.s.i.

FIG. 14 shows a square load plate 900 having sides measuring 4 inches. FIG. 15 is a side view of the load plate 900 shown in FIG. 14. FIG. 15 illustrates that for a square load plate 900 having sides measuring 4 inches, the loaded length will be approximately 2.8 inches. An approximation of the load per square inch for plate 900 yeilds:

load bearing area for plate 900

=4 inches×4 inches/2

=8 square inches load per area for plate 900

=1000 lbs./8 square inches

=125 p.s.i.

As shown by these calculations, loading per square inch for load plate 900 is significantly less than loading per square inch for dowel 200. Therefore, fewer load plates 900 than dowels 200 are needed to transfer a given load, which allows for greater spacing between load plates than between dowels.

This simplified comparison significantly underestimates the advantage provided by a load plate 900 over a prior art dowel having a circular cross-section by ignoring the splitting force produced by the curved shape of a circular dowel. Referring to FIG. 13, the splitting force exerted by circular dowels results from circular dowels producing significantly more force per unit area from the portion of the dowel surface in the middle, as depicted by arrow 1300, relative to the force per unit area produced at its edges, as depicted by arrow 1302.

To install a load plate 900 during creation of a joint 104, a blockout sheath and mounting plate could be used. FIG. 16 is a side view of a possible configuration for blockout sheath 1600. FIG. 17 shows a top view of blockout sheath 1600 from a view in the direction indicated by arrows 17—17. The width of Blockout sheath 1600 tapers from left to right, away from joint 104 (not shown in FIG. 17), as shown by the decreasing length of double-headed arrows 1700-1, 1700-2, and 1700-3 in FIG. 17.

FIG. 18 is a front view of mounting plate 1800. FIG. 19 is side view of mounting plate 1800 as viewed from sectional arrows 19—19 in FIG. 18. FIG. 20 is a top view of mounting plate 1800 as viewed from sectional arrows 20—20 in FIG. 18.

Figure 21:
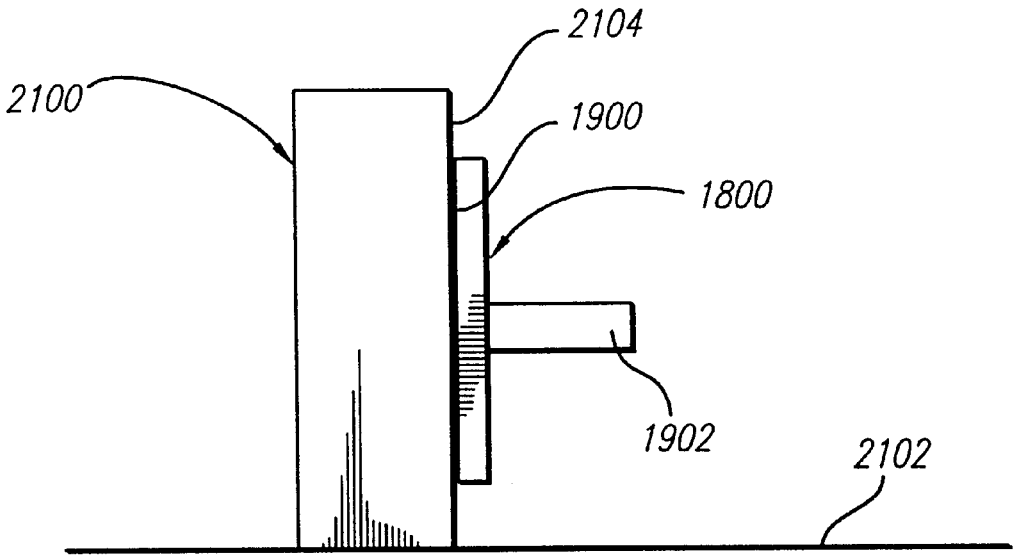
FIG. 21 is a side view of an edge form and mounting plate.

This invention comprises a kit of component parts capable of being assembled during creation of joint 104 between two slabs 102. Referring to FIG. 21, creation of joints 104 between slabs 102 is typically accomplished by placing an edge form 2100 on a base 2102, typically the ground. The edge form 2100 could be a 2×6 inch board of wood, to define a first joint surface. Front face 1900 of mounting plate 1800 could be attached to an edge form surface 2102 that will define the joint surface of a first slab 102, with stub 1902 protruding into a space to be occupied by the first slab, as shown in FIG. 21. Blockout sheath 1600 could then be slipped onto stub 1902. The first slab could then be poured. After allowing the first slab to harden, the edge form and mounting plate 1800 could be removed, leaving blockout sheath 1600 remaining within hardened first slab 102.

A first half or end of load plate 900, for instance, the right-hand half of load plate 900 depicted in FIG. 10, could then be inserted into the blockout sheath 1600 embedded in hardened first slab 102. A second blockout sheath could then optionally be positioned over a second half or end load plate 900, for instance the left-hand side of load plate 900 depicted in FIG. 10. Then, a second slab 104 could be poured and allowed to harden such that the second end of the load plate, and optionally the second blockout sheath, will be embedded in the second slab.

FIG. 22 shows a load plate 900, with its first end inserted into blockout sheath 1600. The width, measured parallel to the joint in a direction indicated by double-headed arrow 2200, of blockout sheath 1600 could be greater than the width, measured in the same direction of load plate 900 for each increasing depth along the direction indicated by arrow 2202, which is perpendicular to the joint. The blockout sheath's greater width could create void 2204 allowing slabs meeting at a joint to move relative to one another in either direction parallel to the joint indicated by double-headed arrow 2200. Deformable centering fins 2206-1 through 2206-4 could also be provided to initially center load plate 900 within blockout sheath 1600, while allowing more movement between the slabs than would be allowed solely by a void created by shrinkage of the slabs, such as void 1100 depicted in FIG. 11. As will be apparent to persons having ordinary skill in the art other suitable arrangements for initially centering load plate 900 within blockout sheath 1600, such as collapsible fingers or other compressible material, could also be used.

As will also be apparent to persons having ordinary skill in the art, shapes other than a square or a diamond may be used without departing from the scope of this invention. Four alternative shapes are shown in FIG. 23. Each alternative shape has its largest width near the central portion of its length. Other suitable shapes could also be used.

This invention has been described with reference to a preferred embodiment. Modifications may occur to others upon reading and understanding the foregoing detailed description. This invention includes all such modifications to the extent that they come within the scope of the appended claims or their equivalents.

We claim:

1. A system for transferring loads across a joint between concrete on-ground cast-in-place slabs, the system comprising:

a first concrete on-ground cast-in-place slab;

a second concrete on-ground cast-in-place slab;

a joint separating the first and second slabs, at least a portion of the joint being initially defined by an inner surface of an edge form, wherein a substantially planar upper surface of the first slab is substantially perpendicular to the inner surface of the edge form, and a longitudinal axis of the joint is formed by an intersection of the inner surface of the edge form and the upper surface of the first slab;

a load plate including a substantially tapered end, the end having upper and lower surfaces, the upper and lower surfaces protruding into the first slab, and a second end protruding into the second slab such that the load plate transfers between the first and second slabs a load applied to either slab directed substantially perpendicular to the upper surface of the first slab;

whereby the load plate restricts relative movement between the first and second slabs in a direction substantially perpendicular to the upper surface of the first slab, and the load plate allows the joint to open by allowing the first and second slabs to move away from each other in a direction substantially perpendicular to the inner surface of the edge form;

the load plate having a width measured parallel to the longitudinal axis of the joint and a length measured parallel to the upper surface of the first slab; and the width of the load plate being:

substantially greater than or equal to the length of the load plate, and generally larger closer to the joint and generally smaller farther away from the joint such that, as the joint opens, increasingly greater relative movement of the first and second slabs in a direction substantially parallel to the longitudinal axis of the joint is allowed.

2. The system of claim 1, wherein a height of the load plate measured perpendicular to the upper surface of the first slab is substantially less than one-eighth of a largest width of the load plate.

3. The system of claim 2, wherein the height of the load plate is approximately one half of an inch.

4. The system of claim 1, wherein the load plate is substantially square and is oriented within the joint such that the upper and lower surfaces of the load plate are substantially parallel to the upper surface of the first slab and such that a first pair of opposing comers of the load plate are oriented substantially parallel to the longitudinal axis of the joint and a second pair of opposing corners of the load plate are oriented substantially perpendicular to the longitudinal axis of the joint.

5. Apparatus for use in transferring a load across a joint between first and second cast-in-place slabs, the joint having a substantially planar joint surface substantially perpendicular to a substantially planar intended upper surface of the first slab, the apparatus comprising:

a blockout sheath adapted to be embedded within the first slab such that a substantially planar top surface and a substantially planar bottom surface of the blockout sheath are substantially parallel to the intended upper surface of the first slab, the top and bottom surfaces of the blockout sheath each having a width parallel to an intersection between the joint surface and the upper surface of the first slab, the width of the top and bottom surfaces of the blockout sheath substantially decreasing away from the joint surface; and a load plate having a substantially tapered end and a remaining portion, the tapered end having substantially planar upper and lower surfaces, the substantially tapered end being adapted to be inserted into the blockout sheath, the upper and lower surfaces of the substantially tapered end being adapted to cooperatively engage the substantially planar upper and lower surfaces of the blockout sheath, the remaining portion of the load plate being adapted to be embedded in the second slab;

the load plate and the blockout sheath being adapted to transfer between the first and second slabs any load applied to either the first or second slab in a direction perpendicular to the intended upper surface of the first slab; and the load plate and the blockout sheath being adapted to allow increasingly greater relative movement of the first and second slabs in a direction parallel to the width of the blockout sheath as the first or second slab moves away from the joint.

6. The apparatus of claim 5 wherein the blockout sheath and the substantially tapered end of the load plate each have a depth perpendicular to the joint surface, the width of the blockout sheath being substantially greater than the width of the substantially tapered end at each corresponding depth along the substantially tapered end and the blockout sheath, such that the substantially tapered end can move within the sheath in a direction parallel to the intersection between the upper surface of the first slab and the joint surface.

7. The apparatus of claim 5 wherein the blockout sheath further comprises means for initially centering the substantially tapered end of the load plate within the width of the sheath.

8. The apparatus of claim 6 wherein the blockout sheath further comprises a plurality of deformable centering fins for initially centering the substantially tapered end of the load plate within the width of the sheath.

9. The apparatus of claim 5 wherein the substantially tapered end of the load plate comprises: a substantially pointed end.

10. The apparatus of claim 5 wherein a largest width of the substantially tapered end of the load plate is substantially no less than twice the depth of the substantially tapered end of the load plate.

11. The apparatus of claim 5 wherein the substantially tapered end of the load plate further comprises a height measured perpendicular to the upper surface of the load plate, the height being substantially less than one-eighth the largest width of the substantially tapered end of the load plate.

12. A load plate kit having component parts capable of being assembled during creation of a joint between first and second cast-in-place slabs, the joint being initially defined by an inner surface of an edge form, a substantially planar intended upper surface of the first slab being substantially perpendicular to the inner surface of the edge form, the kit comprising:

a. a mounting plate adapted to be attached to the edge form;

b. a blockout sheath adapted to be attached to the mounting plate such that a substantially planar top surface and a substantially planar bottom surface of the blockout sheath protrude into a space to be occupied by the first slab, the top and bottom surfaces of the blockout sheath being substantially parallel to the intended upper surface of the first slab, the top and bottom surfaces of the blockout sheath each having a width parallel to an intersection between the edge form and the intended upper surface of the first slab, the width of the top and bottom surfaces of the blockout sheath substantially decreasing away from the joint; and c. a load plate having a substantially tapered end, the end having substantially planar upper and lower surfaces, the end being adapted to be inserted into the blockout sheath, the upper and lower surfaces of the first end adapted to cooperatively engage the substantially planar upper and lower surfaces of the blockout sheath, the load plate and blockout sheath being adapted to transfer between the first and second slabs a load applied to either slab, the load being directed substantially perpendicular to the intended upper surface of the first slab after:

i. the first slab has been poured and has hardened, ii. the edge form and mounting plate have been removed from the first slab, iii. the substantially tapered end of the load plate has been inserted into the blockout sheath such that a remaining portion of the load plate protrudes into a space to be occupied by the second slab, and iv. the second slab has been poured and has hardened.

13. The kit of claim 12 wherein the blockout sheath and the substantially tapered end of the load plate each have a depth perpendicular to the inner surface of the edge form, the width of the blockout sheath being substantially greater than the width of the substantially tapered end at each corresponding depth along the substantially tapered end and the blockout sheath, such that the substantially tapered end can move within the sheath substantially parallel to the intended upper surface of the first slab.

14. The kit of claim 13 wherein the blockout sheath further comprises means for initially centering the substantially tapered end of the load plate within the width of the sheath.

15. The kit of claim 13 wherein the blockout sheath further comprises: a plurality of deformable centering fins for initially centering the substantially tapered end of the load plate within the width of the sheath.

16. The kit of claim 12 wherein the substantially tapered end of the load plate comprises: a substantially pointed end.

17. The kit of claim 12 wherein a largest width of the substantially tapered end of the load plate is substantially no less than twice the depth of the substantially tapered end of the load plate.

18. The kit of claim 12 wherein the load plate further comprises a height measured perpendicular to the upper surface of the first slab, the height being substantially less than one-eighth of a largest width of the substantially tapered end of the load plate.

19. A system for transferring loads across a joint between concrete on-ground cast-in-place slabs, the system comprising:

a first concrete on-ground cast-in-place slab;

a second concrete on-ground cast-in-place slab;

a joint separating the first and second slabs, at least a portion of the joint being initially defined by an inner surface of an edge form, wherein a substantially planar upper surface of the first slab is substantially perpendicular to the inner surface of the edge form, and a longitudinal axis of the joint is formed by an intersection of the inner surface of the edge form and the upper surface of the first slab;

a plurality of load plates each having upper and lower surfaces, the upper and lower surfaces protruding into the first slab and into the second slab such that the load plates transfer between the first and second slabs a load applied to either slab directed substantially perpendicular to the upper surface of the first slab;

whereby the load plates restrict relative movement between the first and second slabs in a direction substantially perpendicular to the upper surface of the first slab, and the load plates allow the joint to open by allowing the first and second slabs to move away from each other in a direction substantially perpendicular to the inner surface of the edge form;

the load plates each having a largest width measured parallel to the longitudinal axis of the joint and a largest length measured perpendicular to the inner surface of the edge form, the largest width of the load plates being substantially the same as the largest length of the load plates; and the load plates having a height, measured perpendicular to the upper surface of the first slab, that is substantially less than one-eighth of the largest width of the load plates.

20. The system of claim 19, wherein the height of the load plates is approximately one half of an inch.

21. At a joint separating a first concrete on-ground cast-in-place slab from a second concrete on-ground cast-in-place slab, at least a portion of the joint being initially defined by an inner surface of an edge form, a substantially planar upper surface of the first slab being substantially perpendicular to the inner surface of the edge form, a longitudinal axis of the joint being formed by an intersection of the inner surface of the edge form and the upper surface of the first slab, the improvement comprising: a load plate adapted for transferring loads between the first cast-in-place slab and the second cast-in-place slab, the load plate including:

a substantially tapered end, the end having substantially planar upper and lower surfaces, the upper and lower surfaces of the first end being adapted to protrude into the first slab; and a second end protruding into the second slab such that the load plate transfers, between the first and second slabs, a load applied to either slab directed substantially perpendicular to the upper surface of the first slab;

the load plate restricting relative movement between the first and second slabs in a direction substantially perpendicular to the upper surface of the first slab;

the load plate allowing the joint to open by allowing the first and second slabs to move away from each other in a direction substantially perpendicular to the inner surface of the edge form; and the substantially tapered end of the load plate having a width measured parallel to the longitudinal axis of the joint, the width of the tapered end being generally larger closer to the joint and generally smaller farther away from the joint such that, as the joint opens, the substantially tapered end of the load plate allows increasingly greater relative movement of the first and second slabs in a direction substantially parallel to the longitudinal axis of the joint.

22. The improvement according to claim 21, wherein the substantially tapered end of the load plate comprises: a substantially pointed end.

23. The improvement according to claim 21, wherein a largest width of the substantially tapered end of the load plate is substantially no less than twice a depth, measured perpendicular to the joint, of the substantially tapered end of the load plate.

24. The improvement according to claim 21, wherein a height of the load plate measured perpendicular to the upper surface of the first slab is substantially less than one-eighth of a largest width of the substantially tapered end of the load plate.

25. The improvement according to claim 24, wherein the height of the load plate is approximately one half of an inch.

26. The improvement according to claim 25, wherein the load plate is substantially square and is oriented within the joint substantially parallel to the intended upper surface of the first slab and such that there is an angle of approximately 45 degrees between the longitudinal axis of the joint and each of the four sides of the load plate.

* * * * *